US005988492A

United States Patent [19]

Capy et al.

[11] Patent Number: 5,988,492

[45] Date of Patent: Nov. 23, 1999

[54] PLEATED PACKAGE HAVING A REINFORCED CENTRAL REGION WITH PRE-EXPANDED PLEATS

[76] Inventors: Gilbert Capy, La Botte, Jarnioux, France, F-69640; Akiva Buchberg, 5030 Pine Tree Dr., Miami Beach, Fla. 33140

[21] Appl. No.: 08/973,010

[22] PCT Filed: May 31, 1996

[86] PCT No.: PCT/FR96/00813

§ 371 Date: Nov. 25, 1997

§ 102(e) Date: Nov. 25, 1997

[87] PCT Pub. No.: WO96/38347

PCT Pub. Date: Dec. 5, 1996

[30] Foreign Application Priority Data

Jun. 2, 1995 [FR] France ..... 95 06794

[51] Int. Cl.[6] ..... B65D 65/22

[52] U.S. Cl. ..... 229/122.34; 229/87.03

[58] Field of Search ..... 229/122.34, 87.03, 229/87.02; 383/120

[56] References Cited

U.S. PATENT DOCUMENTS

| | | | |
|---|---|---|---|
| 1,940,596 | 4/1933 | Koppelman | 229/87.02 X |
| 1,948,615 | 2/1934 | Clark | 229/87.03 X |
| 2,586,078 | 2/1952 | O'malley | 229/87.03 X |
| 4,795,648 | 1/1989 | Capy et al. | 229/87.03 X |
| 5,125,564 | 6/1992 | Capy | 229/87.03 |
| 5,131,586 | 7/1992 | Capy | 229/87.03 |
| 5,364,016 | 11/1994 | Capy et al. | 229/87.03 |
| 5,518,176 | 5/1996 | Capy et al. | 229/87.03 |
| 5,580,625 | 12/1996 | Capy et al. | 229/87.03 X |
| 5,590,783 | 1/1997 | Capy et al. | 229/87.03 X |
| 5,743,460 | 4/1998 | Capy et al. | 229/87.03 |

*Primary Examiner*—Stephen P. Garbe
*Assistant Examiner*—Tri M. Mai
*Attorney, Agent, or Firm*—Kane, Dalsimer, Sullivan, Kurucz, Levy, Eisele and Richard, LLP

[57] ABSTRACT

A package made from a flexible pleated sheet with a central region reinforced by the addition of a second pleated sheet. Folding and unfolding is made easier by having a central area with semi-extended pleats with a side area having flattened pleats.

4 Claims, 3 Drawing Sheets

PLEATED PACKAGE HAVING A REINFORCED CENTRAL REGION WITH PRE-EXPANDED PLEATS

The invention is an improvement of Patents FR-A-2,595,666 and FR-A-2,673,909 which consists of a new way in which to pleat a flexible sheet with semi-rigid regions in order to make it into a package capable of supporting loads, for convex bodies and, in particular, for packaging sandwiches made from round loaves.

Patent FR-A-2,595,666 describes a package for convex bodies produced from a flexible sheet which has been pleated to form flat pleats. One of the applications of this patent is in the packaging of sandwiches produced from round loaves. Use of this package requires the use of very thin papers because the sandwiches, which are very fragile in consistency when they are made, risk being damaged when packaged. Owing to the consistency of the sandwiches, some fast-food chains require sandwich packages to have sufficient lift ability to support, for example, two other sandwiches, without collapsing. The solution currently used is a thermo-formed polystyrene-foam box, which poses serious environmental problems, and a compact cardboard box, which is very expensive. A major fast-food chain uses a micro-fluted cardboard box, which is lighter but which is three times as heavy as a paper package. It is has been proposed in Patent FR-A-2,676,037 to place in the median part of the sheet used for pleating, according to Patent FR-A-2,595,666, to secure on the sheet before it is pleated, a strip perpendicular to the pleats so as to provide new performance levels in a specific region. One application of this principle is to secure, in the median part of the sheet before pleating, a strip for increasing the rigidity of this region and to form what will hereinafter be referred to as a reinforced central region. When the package according to Patent FR-A-2,595,666 is expanded, this reinforced central region forms a vertically placed belt which provides vertical lift ability. The more rigid the belt thus formed, the more difficult it is for the package to expand around the sandwich and the fragility of the sandwich is such that it risks being damaged. It is therefore necessary to attempt to lighten this reinforcement region as much as possible and, to compensate for this lightening, to give it a shape which makes it possible to increase the vertical strength, i.e. parallel to the direction of the pleats, whilst reducing it in the direction of expansion of the pleats. To increase the vertical strength, one solution consists in giving an appropriate shape to the strength region when it is expanded. One solution consists in using a reinforcement strip with flutings; the problem is that, when the flat pleats are made, as described in Patent FR-A-2,595,666, the flutings are squashed and then lose the essence of their characteristics. A further solution consists in giving the reinforced central region, when it is expanded, a corrugated form or a zigzag form. Expansion of the pleats from flat pleats does not make it possible to ensure satisfactory distribution of the zigzags right around the sandwich; in particular, it is possible for them to disappear in certain regions. One way in which to solve this problem is to produce concertina pleats instead of flat pleats, as described in Patent FR-A-2,673,909; concertina pleats are easier to expand, but the problem is still one of the satisfactory distribution of the zigzag pleats around the convex body and, moreover, that of fixing the pleats at their ends, which is difficult to carry out on a high-speed machine because it requires at least one change in direction.

The object of the invention is to propose a pleating method which makes it possible to solve the problems of pleating and unpleating packages in the reinforced central region.

Figure 1:
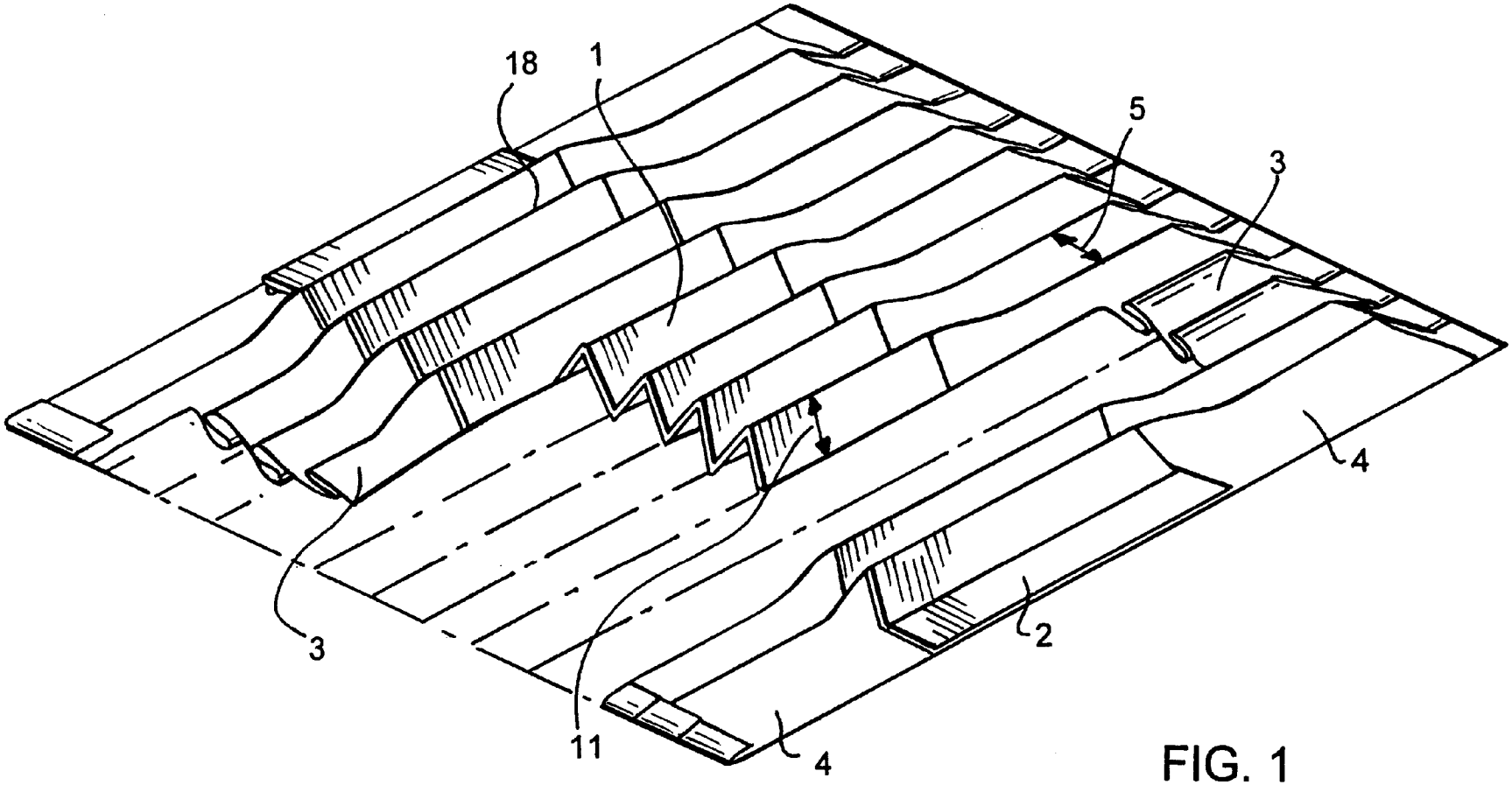
FIG. 1 shows the package according to the invention, pleated with various cut-outs to show the difference in pleating between the regions.
Figure 2:
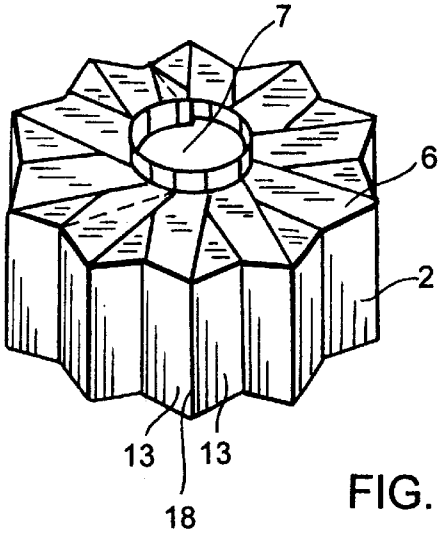
FIG. 2 shows the same package when it is expanded around a convex body.

The invention consists in producing a package (FIG. 1) which has a mixed pleat which is a concertina pleat 1 in the part corresponding to the reinforced central region 2 which progressively becomes a flat pleat 3 in the side regions 4 and which is secured at its end using any available technique. In the reinforced central region 2 the concertina pleat 1 is semi-expanded. The level of pre-expansion of this concertina pleat may be calculated by varying the pitch 5 of the flat pleat 3 when it is pleated. With such a pleating method, the package 6 (FIG. 2) is expanded around the convex body 7 as indicated in Patent FR-A-2,595,666, but with much less of an expansion force. The concertina pleats are distributed around the side portion of the convex body 7 and form dihedral portions which markedly increase the vertical load strength of the reinforced central region 2. Obviously, during selection, account must be taken of the length of the expanded package and the length of the sheet and the number of pleats must be increased as a function of the angle it is desired to give to these dihedral portions in order to make them as efficient as possible.

Figure 5:
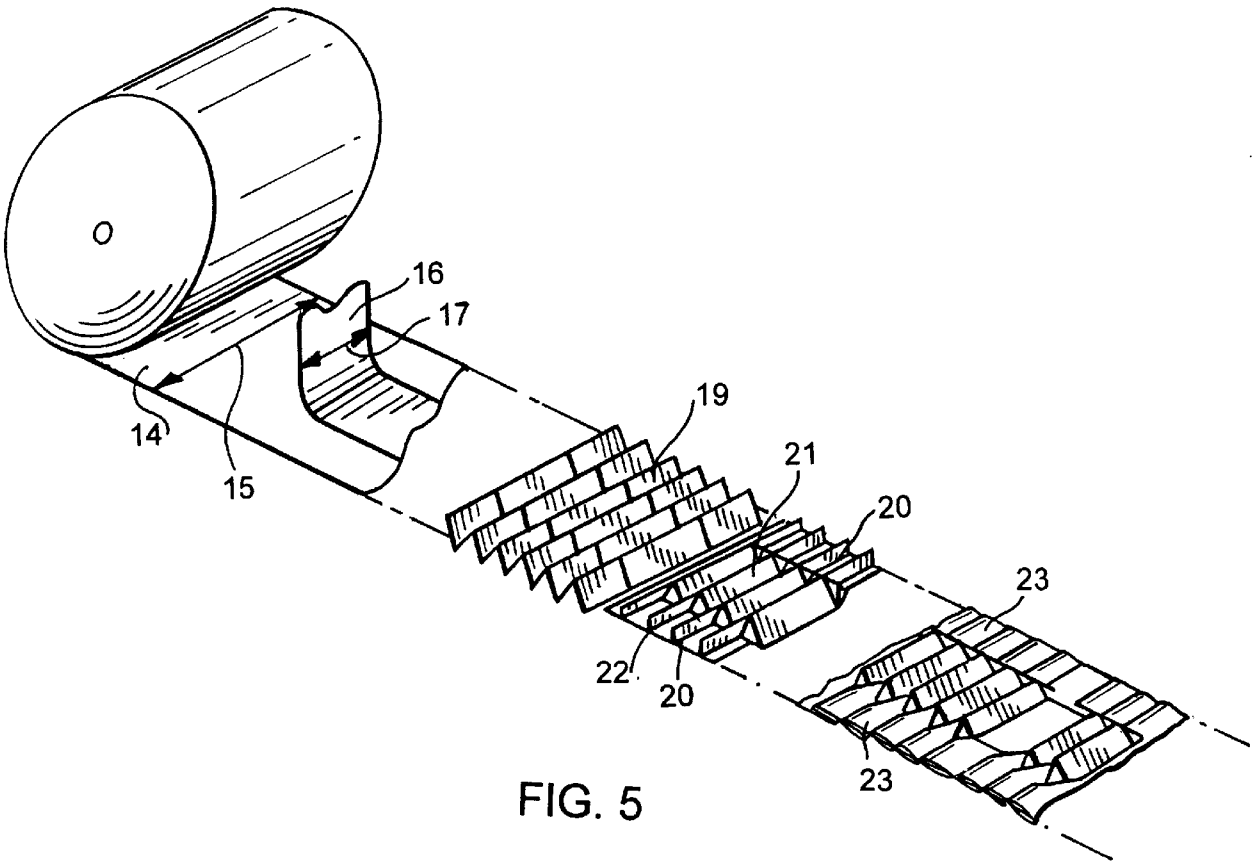
FIG. 5 shows the various stages required for manufacturing the package according to the invention.

By way of non-limiting example, for packaging a sandwich measuring 100 mm in diameter and 60 mm in height, a flexible sheet 14 (FIG. 5), measuring 175 mm in width 15, a reinforcement strip 16 with a width 17 measuring 60 mm, may be chosen, and a package may be made which has approximately 20 concertina pleats 1 (FIG. 1) with a width 11 measuring 12.5 mm.

Figure 4:
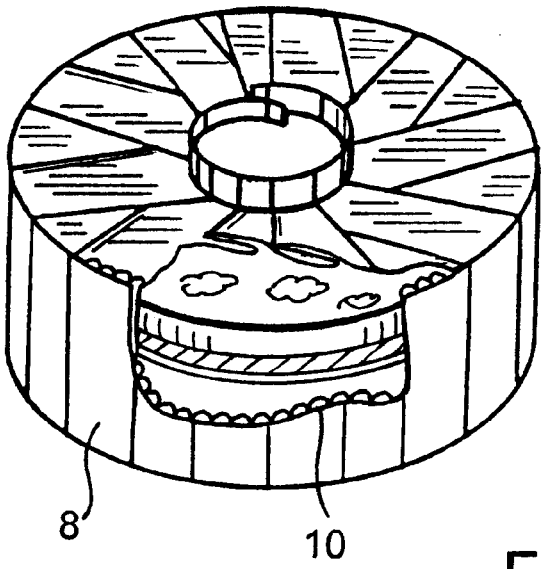
FIG. 4 shows a package according to the invention, which has a fluted sheet, when it is expanded around a round sandwich; a cut-out shows the position of the flutings.
Figure 3:
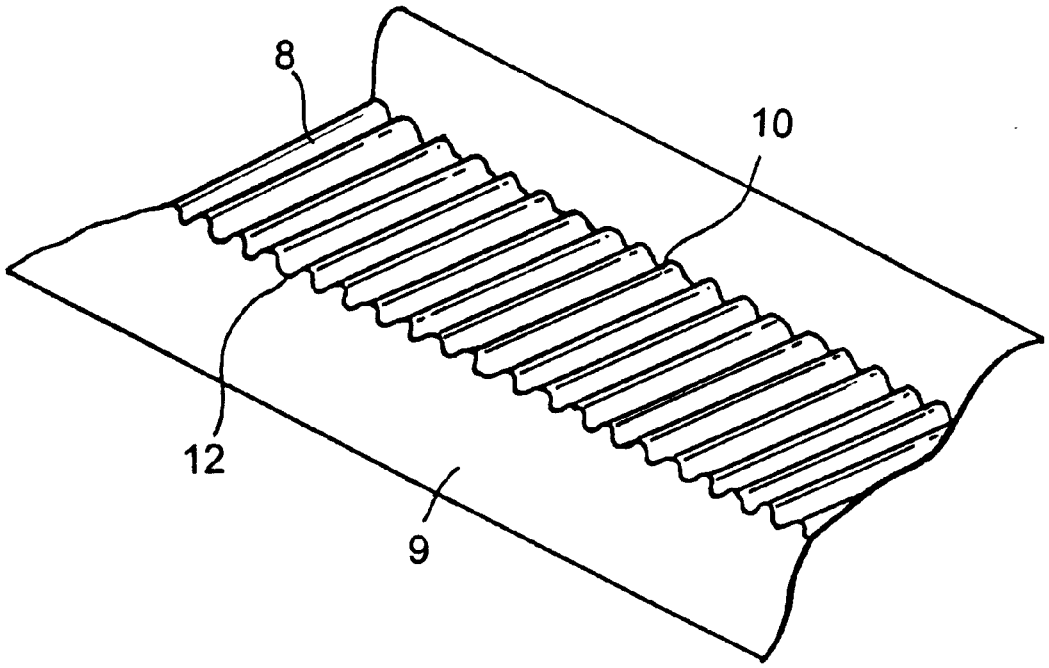
FIG. 3 shows the flexible sheet which has a reinforcement formed by a fluted sheet.

If the reinforced central region 8 (FIG. 3) is formed from a reinforcement strip 10 which is fluted in the direction of the pleats, secured to the flexible sheet 9 by glueing or welding along lines 12 where the flutings 10 come into contact with the flexible sheet 9, with flutings 10 whose pitch is much smaller than the width 11 (FIG. 1) of the concertina pleats 1, the flutings 10 (FIG. 3) are not squashed outside of the ridges 18 (FIG. 1) of the concertina pleats and satisfactory strength may be obtained, in combination with the fluted structure, while having fully expanded all the pleats in order to form a reinforced central region 8 (FIG. 4) which is annular and not, as previously, formed from dihedral portions, and which has a suitable vertical lift ability by virtue of the flutings which are parallel to the generatrices of the annular region. Reinforcement with the aid of flutings may be obtained by securing a thin strip of paper, which has been previously corrugated using known techniques, directly to the flexible sheet in order to form, in this region, what may be referred to as a single-face corrugated carton. Although, in the previous example, 20 pleats were needed to package a sandwich, with dihedral portions forming suitable angles, an equivalent result may be obtained with only 15 pleats, hence a substantial saving of material. The case of pleats 1 (FIG. 1) when they are in concertina form has been described, but any other form of semi-expanded pleats is within the field of the present invention and, in particular, asymmetrical pleats.

Such a package may be manufactured using a machine derived from that described in Patents FR-A-2,661,404 and FR-A-2,663,621. Firstly, the reinforcement strip 16 (FIG. 5) and the flexible sheet 14 are assembled. The assembly is then passed over pre-forming wheels in order to obtain concertina pleats over the entire width. Next, the pleats are transferred onto the wheel for constricting the pleats, which shapes the side region 20 of the pleats 19 which is not reinforced in order subsequently to be able to flatten them while constricting the accordion pleats 21 at the same pitch as that of the side pleats 22 after shaping. Finally, the side pleats 23 are flattened and the ends are secured as already described, in particular in Patents FR-A-2,595,719 and FR-A-2,628,719.

We claim:

1. A package comprising:

a) an outer wrap made from a first pleated rectangular flexible sheet having opposing sides and a reinforced central region (2) and having a plurality of flutings having a plurality of fold lines at said reinforced central region (2) which are semi-extended and extend to the opposing sides of said first sheet, said opposing sides having flattened pleats; and b) a second sheet having a plurality of flutings having a plurality of fold lines being semi-extended, said second sheet being secured along lines where the flutings come into contact with said first sheet wherein each flute of a plurality of flutes of the second sheet is in interposing overlapping engagement with a corresponding flute of the reinforced central region.

2. The package in accordance with claim 1 wherein upon expansion of the package, the reinforced central region has an annular shape with the flutings of the first sheet in a position parallel to and extending around the opposing sides of the first sheet to form a circle.

3. The package in accordance with claim 1 wherein the flutings of the reinforced central region are accordion-pleated and semi-extended and being prolonged at lateral regions in the form of recumbent folds, whereupon the expansion of the package causes the reinforced central region to form dihedrons (13) having a common edge.

4. The package in accordance with claim 3, wherein the flutings of the reinforced central region are flat pleats.

* * * * *